US010808675B2

(12) United States Patent
Bucher et al.

(10) Patent No.: US 10,808,675 B2
(45) Date of Patent: Oct. 20, 2020

(54) AXIAL PISTON MACHINE

(71) Applicant: Mahle International GmbH, Stuttgart (DE)

(72) Inventors: Michael Bucher, Berlin (DE); Mirko Guenther, Berlin (DE); Michael Hoetger, Berlin (DE); Michael Kreisig, Gerlingen (DE); Hannes Marlok, Leonberg (DE); Falk Schneider, Korntal-Muenchingen (DE)

(73) Assignee: MAHLE INTERNATIONAL GMBH (DE)

( * ) Notice: Subject to any disclaimer, the term of this patent is extended or adjusted under 35 U.S.C. 154(b) by 344 days.

(21) Appl. No.: 15/557,102

(22) PCT Filed: Feb. 18, 2016

(86) PCT No.: PCT/EP2016/053460
§ 371 (c)(1),
(2) Date: Sep. 9, 2017

(87) PCT Pub. No.: WO2016/142144
PCT Pub. Date: Sep. 15, 2016

(65) Prior Publication Data

US 2018/0045173 A1 Feb. 15, 2018

(30) Foreign Application Priority Data

Mar. 11, 2015 (DE) ..... 10 2015 204 385

(51) Int. Cl.
*F03C 1/40* (2006.01)
*F03C 1/32* (2006.01)
*F03C 1/06* (2006.01)

(52) U.S. Cl.
CPC ..... *F03C 1/0684* (2013.01); *F03C 1/0626* (2013.01); *F03C 1/0636* (2013.01)

(58) Field of Classification Search
CPC ..... F03C 1/0684; F03C 1/061; F03C 1/0626; F03C 1/0628; F01B 3/101
See application file for complete search history.

(56) References Cited

U.S. PATENT DOCUMENTS 2,548,501 A 4/1951 Simpson et al.
3,183,849 A * 5/1965 Raymond ..... F04B 1/14 417/270

(Continued)

FOREIGN PATENT DOCUMENTS

DE 259069 C 4/1913
DE 2161518 A1 6/1972

(Continued)

OTHER PUBLICATIONS

English abstract for DE-102011118622.

*Primary Examiner* — Patrick Hamo
*Assistant Examiner* — David N Brandt
(74) *Attorney, Agent, or Firm* — Fishman Stewart PLLC

(57) ABSTRACT

An axial piston machine may include a rotor rotatably mounted in a housing. A plurality of cylinders may be arranged in a ring around the rotor. A plurality of pistons may each be arranged within each of the plurality of cylinders and may be constructed and arranged to selectively translate within the plurality of cylinders. A plurality of inlet openings may be defined in a cylinder head and at least one outlet opening may be defined in the housing. The plurality of cylinders may be in operative communication with the plurality of inlet openings and the at least one outlet opening. An inlet channel may be defined in the cylinder head and may extend to each of the plurality of inlet openings. An outlet channel may be defined in the housing and may be in operative communication with the at least one outlet opening. A bypass channel may be defined in the housing and may extend from the cylinder head into one of the outlet (Continued)

channel or a swashplate space. A bypass valve may be connected to the cylinder head or may be integrated with the cylinder head. The bypass valve may be constructed and arranged to selectively apportion a working medium to the inlet channel and the bypass channel based on a switching position of the bypass valve.

18 Claims, 5 Drawing Sheets

(56) References Cited

U.S. PATENT DOCUMENTS

| | | | | |
|---|---|---|---|---|
| 3,623,402 | A | 11/1971 | Kubilos | |
| 3,771,419 | A | 11/1973 | Hyde | |
| 4,007,663 | A * | 2/1977 | Nagatomo | F04B 1/2021 91/6.5 |
| 5,636,973 | A * | 6/1997 | Sonobe | F04B 27/1804 417/222.2 |
| 6,105,928 | A * | 8/2000 | Ise | F04B 27/1804 251/118 |
| 6,212,893 | B1 | 4/2001 | Ban et al. | |
| 2013/0318967 | A1 * | 12/2013 | Gaertner | F01K 23/065 60/615 |

FOREIGN PATENT DOCUMENTS

| | | | |
|---|---|---|---|
| DE | 102010052508 | A1 | 5/2012 |
| DE | 102011118622 | A1 | 5/2013 |
| GB | 218061 | A | 7/1924 |
| GB | 1391006 | A | 4/1975 |
| WO | WO-2014128266 | A1 | 8/2014 |

* cited by examiner

AXIAL PISTON MACHINE

CROSS-REFERENCE TO RELATED APPLICATIONS

This application claims priority to International Patent Application No.: PCT/EP2016/053460 filed on Feb. 18, 2016, and German Patent Application No.: DE 10 2015 204 385.1 11 filed Mar. 11, 2015, the contents of which are incorporated herein by reference.

TECHNICAL FIELD

The present invention relates to an axial piston machine comprising a shaft which is connected in a torque-proof manner to a swashplate. The invention additionally relates to a heat recovery system with such an axial piston machine.

In internal combustion engines it is known that only 40% of the energy stored in the fuel is used for movement of the piston and therefore for driving the internal combustion engine. The remaining energy produced in the course of the combustion is principally removed from the internal combustion engine in the form of heat by escaping combustion exhaust gases. In order to reduce these heat losses and therefore increase the efficiency of the internal combustion engine, it is known to couple an axial piston machine to the internal combustion engine.

DE 10 2011 118 622 A1 teaches, for example, a generic axial piston machine comprising a shaft which is connected in a torque-proof manner to a swashplate. A plurality of cylinders are arranged coaxially to the shaft and annularly around this, in which constructed and hollow pistons are arranged translationally adjustably in each case. Each of these pistons is coupled to the swashplate via an appurtenant spherical bearing and a sliding block, whereby a movement of the respective piston brings about a drive of the swashplate and therefore a driving of the shaft. Via a rotary valve disk having an eccentrically arranged through opening, each inlet opening of a cylinder is swept once during each revolution and working medium is thereby supplied to the respective cylinder. In the central region of the axial piston machine, a cavity is provided, which is delimited by the cylinder head wherein the outlet openings pertaining to the cylinder head are guided through the cylinder block in such a manner that a temporary connection can be made between the cavity and the expansion volume of the cylinder via the off-axis through opening in the circumferential rotary valve disk. In particular, the efficiency should be able to be increased as a result.

WO 2014/128266 A1 teaches another axial piston machine which has a bypass channel for bypassing the same. This bypass channel completely bypasses the axial piston machine so that an extra bypass line and corresponding branches and a bypass valve are to be provided for this.

The present invention is concerned with the problem of providing an improved or at least at alternative embodiment for an axial piston machine of the generic type which in particular enables an improved control of the axial piston machine with simultaneously reduced installation space requirement.

This problem is solved according to the invention by the subject matters of the independent claims. Advantageous embodiments are the subject matter of the dependent claims.

SUMMARY

The present invention is based on the general idea of providing an axial piston machine with a bypass channel wherein the bypass channel is integrated in a cylinder head and a housing of the axial piston machine and is thereby optimized in terms of installation space. Compared to axial piston machines known from the prior art, therefore in particular no external separate arrangement of the bypass channel is required. The axial piston machine according to the invention thereby has in a known manner a rotor rotatably mounted in a housing and cylinders arranged in an annular manner and at an angle to the rotor in which pistons are arranged in a translationally adjustable manner. In this case, the cylinders are arranged in a range of +/−30° to the rotor, in particular 0°, i.e. parallel to the rotor. Each cylinder is assigned an inlet opening in the cylinder head and at least one outlet opening in the housing. According to the invention, an inlet channel leading to the inlet opening and an outlet channel connected in a communicating manner to the outlet opening are provided in the housing. Furthermore, a bypass channel is provided which extends from the cylinder head via the housing onto the outlet channel or a swashplate space. Also provided is a bypass valve which is either connected to the cylinder head or is even integrated in this and which apportions an inflow of working medium to the inlet channel and the bypass channel depending on a switching position thereof. In particular the second embodiment in which not only the bypass channel is integrated in the cylinder head and the housing but in addition the bypass valve is integrated in the cylinder head is an embodiment which is particularly optimized in terms of installation space. Compared to axial piston machines known from the prior art, however, the first-mentioned alternative in which the bypass valve is arranged on the cylinder head or is connected to this is already an appreciable improvement since the bypass channel is completely integrated in the cylinder head and the housing and as a result separate laying of a corresponding bypass line or a corresponding bypass channel is no longer required. The axial piston machine according to the invention can thus be controlled or regulated particularly exactly and as a result of the previously described integration of the bypass channel in the cylinder head and the housing, is extremely compact. In the axial piston machine according to the invention, a separation of lubricant contained in the working medium is additionally made possible as is already provided in active operation with the result that in particular a lubrication of a swashplate can be particularly advantageously ensured. As a result of the improved lubrication, a significant improvement can be achieved when restarting. As a result of the bypass channel integrated at least partially in the housing, a more rapid heating of the axial piston machine can be achieved whereby the efficiency thereof is improved and thus an earlier switch-on of the axial piston machine can be achieved.

If the bypass valve is integrated in the cylinder head, as already explained previously, a particularly compact embodiment can be achieved which allows an improved heat transfer compared to the axial piston machine known from the prior art. On the one hand, external lines can be omitted which otherwise mean an unnecessary heat loss and on the other hand, as a result of the direct structural proximity the heat input is directly in or on the housing of the axial piston machine.

Expediently the bypass valve is fastened to the outside of the cylinder head via a decoupling element. Such an attached design in particular also allows the provision of the bypass valve as merely an optional component since this can for example be flange-mounted in a modular fashion and in particular can also be retrofitted. In order to be able to thermally decouple the bypass valve from the cylinder head, the decoupling element is configured for example as a plastic part, in particular as an elastomer element.

In another advantageous embodiment of the solution according to the invention, a braking device for braking the rotor and for fixing the same in a predefined rotational position is provided in the cylinder head wherein the braking device for example can be actuated by means of compressed air or by means of the working medium. In this case, it can be provided that a braking channel is arranged in the cylinder head which is connected at one end to the bypass valve and at the other end to the braking device so that the braking device can be actuated via the bypass valve. By means of the braking device, it is possible for example to fix the rotor in a predefined rotational position in which an eccentric opening of a rotary valve disk connected in a torque-proof manner to the rotor is aligned with an inlet opening of a cylinder wherein the piston of this cylinder is located in the area of an upper dead point and is displaced in the direction of the lower dead point when working medium flows in. A reliable and forceful starting of the axial piston machine is thereby possible.

Expediently the braking device comprises a pin which in the predefined rotational position engages in a recess arranged on the rotary valve disk and fixes this. Such a recess can be arranged, for example on an external edge of the rotary valve disk. Purely theoretically a braking action could be achieved by means of the bypass valve even without the braking channel if the bypass valve specifically switches a counterpressure when the respective piston, in the outlet opening of which working medium is blown, rests in the lower dead point. In this case, the inlet opening of this cylinder is closed so that the bypass stream flowing in via the outlet opening builds up a pressure and prevents travel of the piston as far as the upper dead point.

In a further advantageous embodiment of the solution according to the invention, a connecting channel is provided between the inlet channel and the bypass channel in which an overpressure valve is arranged. By means of such an overpressure valve, the axial piston machine can be closed off at a predefined overpressure independently of the bypass valve since working medium can then be blown out directly from the inlet channel via the connecting channel into the bypass channel. As a result, the axial piston machine is shut off until a subcritical pressure is again present and specifically without the bypass valve itself needing to be switched. This therefore enables a particularly rapid switching.

In an advantageous embodiment the bypass channel is arranged at right angles to the respective external surfaces in each case and thereby enables a particularly simple and cost-effective manufacture of the bypass channel.

In an advantageous embodiment of the solution according to the invention corresponding to the second alternative, in which the bypass channel opens into the swashplate space, this has a nozzle at its end facing the swashplate space or such a nozzle is arranged there. This nozzle is directed onto an impact surface of a sliding foot connected to the piston and thus serves as a starting aid whereby a vapour jet emerging therefrom presses the piston downwards. When starting the axial piston machine, a translational starting impulse can be applied to the sliding foot and a rotational starting impulse can be applied to the swashplate via the nozzle.

Further important features and advantages of the invention are obtained from the subclaims, from the drawings and from the relevant description of the figures with reference to the drawings.

It is understood that the features mentioned previously and to be explained further hereinafter can be used not only in the respectively given combination but also in other combinations or alone without departing from the scope of the present invention.

Preferred exemplary embodiments of the invention are presented in the drawings and are explained in detail in the following description, where the same reference numbers relate to the same or similar or functionally the same components.

BRIEF DESCRIPTION OF THE DRAWINGS

In a schematic representation, not to scale.

DETAILED DESCRIPTION

Figure 1:
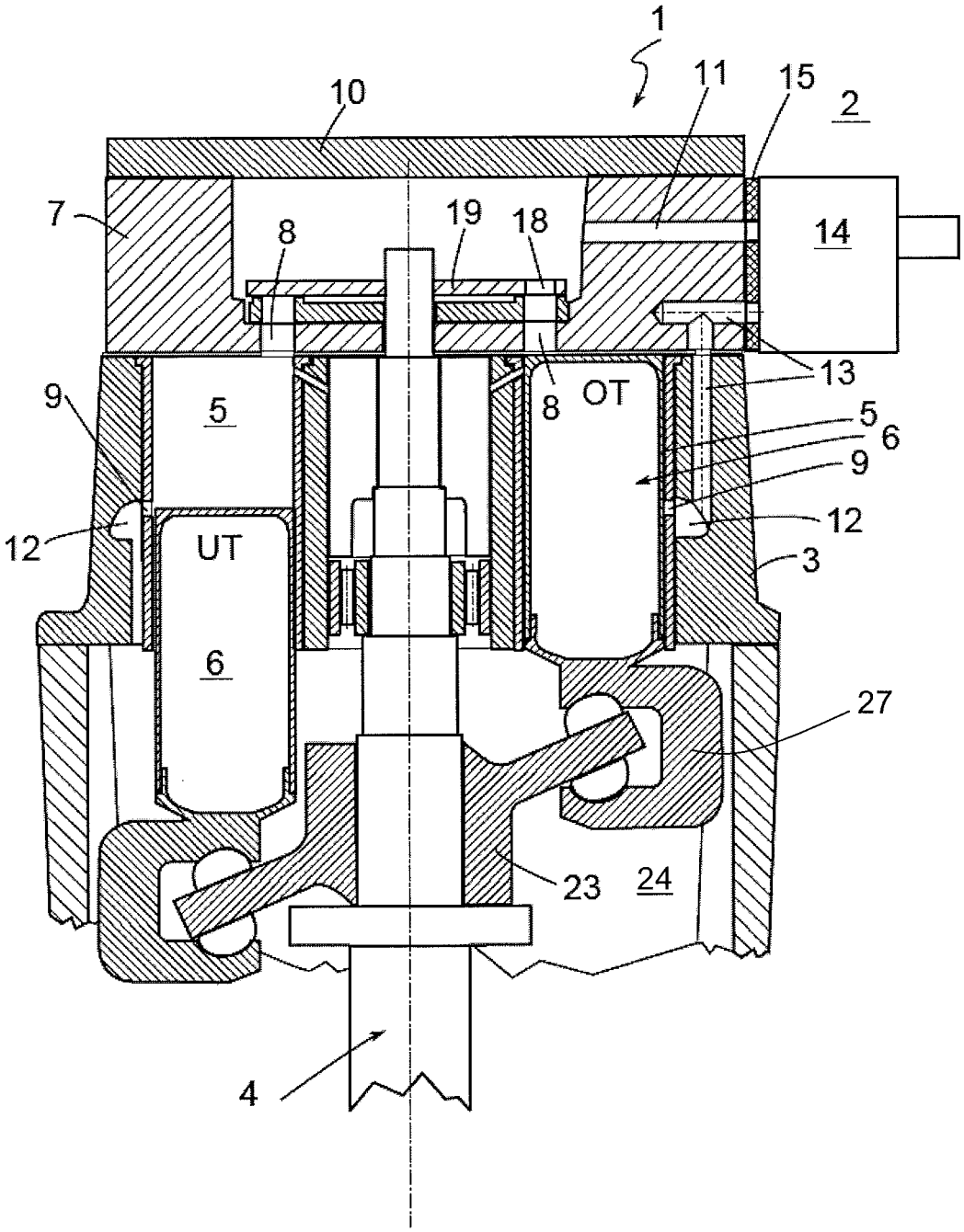
FIG. 1 shows a sectional view through an axial piston machine according to a first embodiment.
Figure 2:
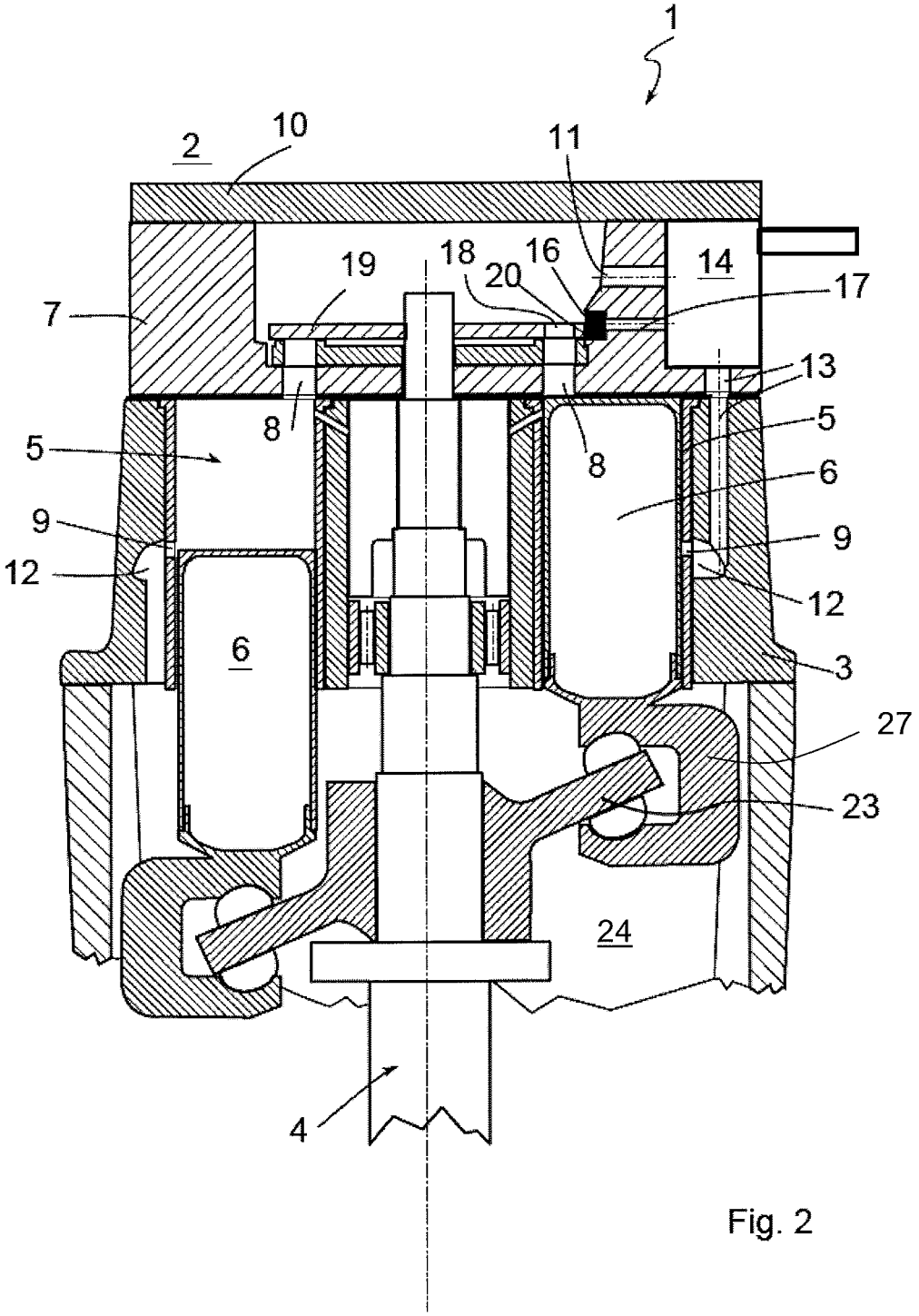
FIG. 2 shows a view as in FIG. 1 but with a bypass valve integrated in a cylinder head of the axial piston machine.

According to FIGS. 1 to 5, an axial piston machine 1 according to the invention which for example can be part of a heat recovery system 2 not explained in detail in a motor vehicle, comprises a rotor 4 mounted rotatably in a housing 3. Cylinders 5 are arranged in a ring around and parallel to the rotor 4 in the housing 3, in which pistons 6 are mounted in a translationally adjustable manner. Each piston 6 is firmly connected to a sliding foot 27 which in turn is coupled to a swashplate via a sliding block. Each cylinder 5 is assigned an inlet opening 8 in a cylinder head 7 and an outlet opening 9 in the housing 3. Towards the top the cylinder head 7 is terminated by means of a cover 10. According to the invention, an inlet channel 11 leading to the inlet opening 5 is now provided in the cylinder head 7 and an outlet channel 12 connected in a communicating manner to the outlet opening 9 is provided in the housing 3. Also provided is a bypass channel 13 which extends from the cylinder head 7 via the housing 3 as far as the outlet channel 12 (FIGS. 1 to 3 and 5) or as far as into a swashplate space 24 (cf. FIG. 4). Furthermore, a bypass valve 14 is provided according to the invention which is connected to the cylinder head 7 according to FIGS. 1 and 3, i.e. is fastened to the outside of this and which according to FIG. 2 is integrated in the cylinder head 7. The bypass valve 14 apportions an inflow of working medium to the inlet channel 11 and the bypass channel 13 depending on its switching position.

By integrating the bypass channel 13 in the cylinder head 7 and the housing 3, this can be arranged in a manner optimized in terms of installation space, wherein at the same time further components such as for example lines and branches as would be necessary in external bypass channels known from the prior art can be omitted.

Figure 3:
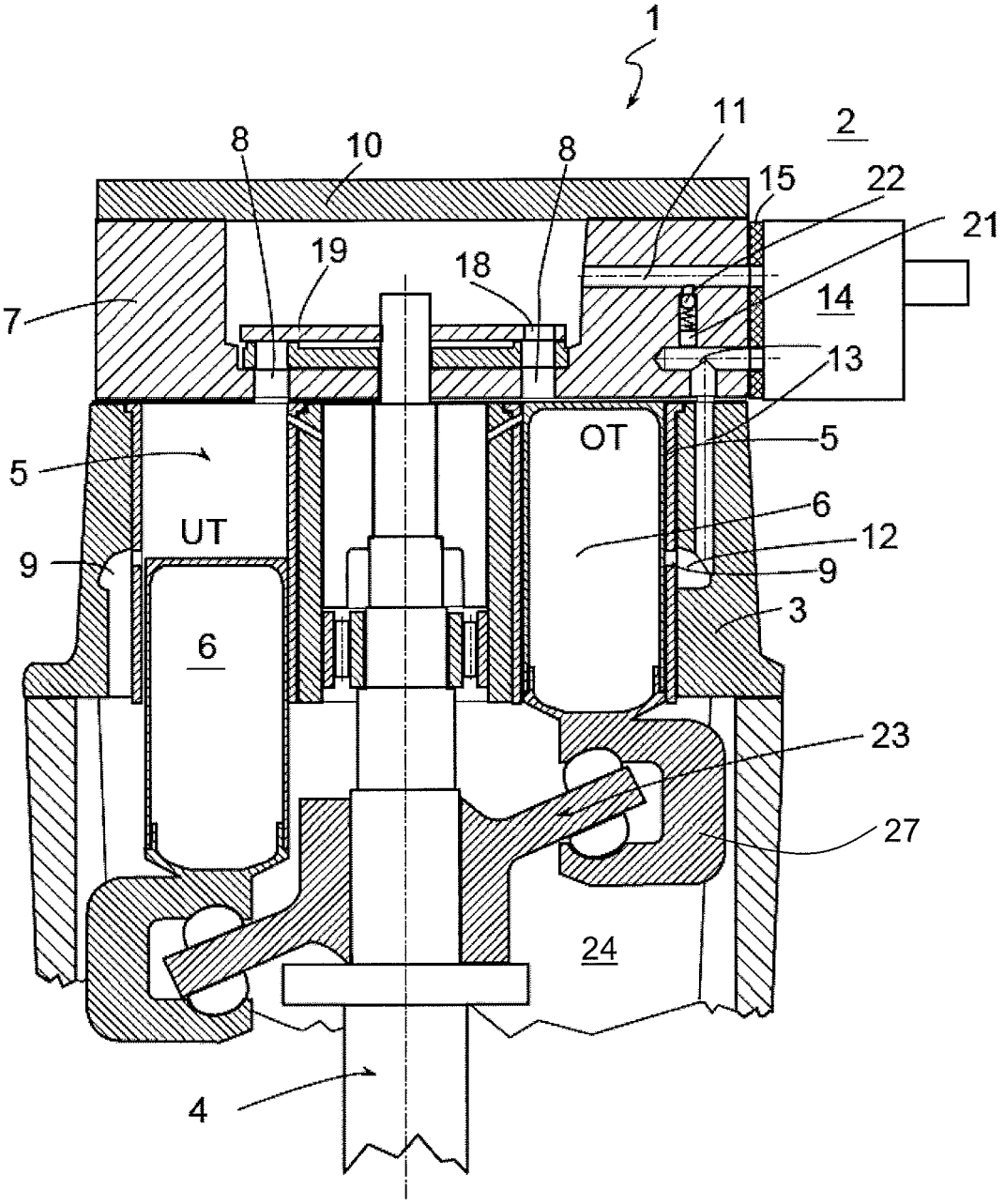
FIG. 3 shows a view as in FIG. 1 but with a connecting channel between the bypass channel and an inlet channel.
Figure 4:
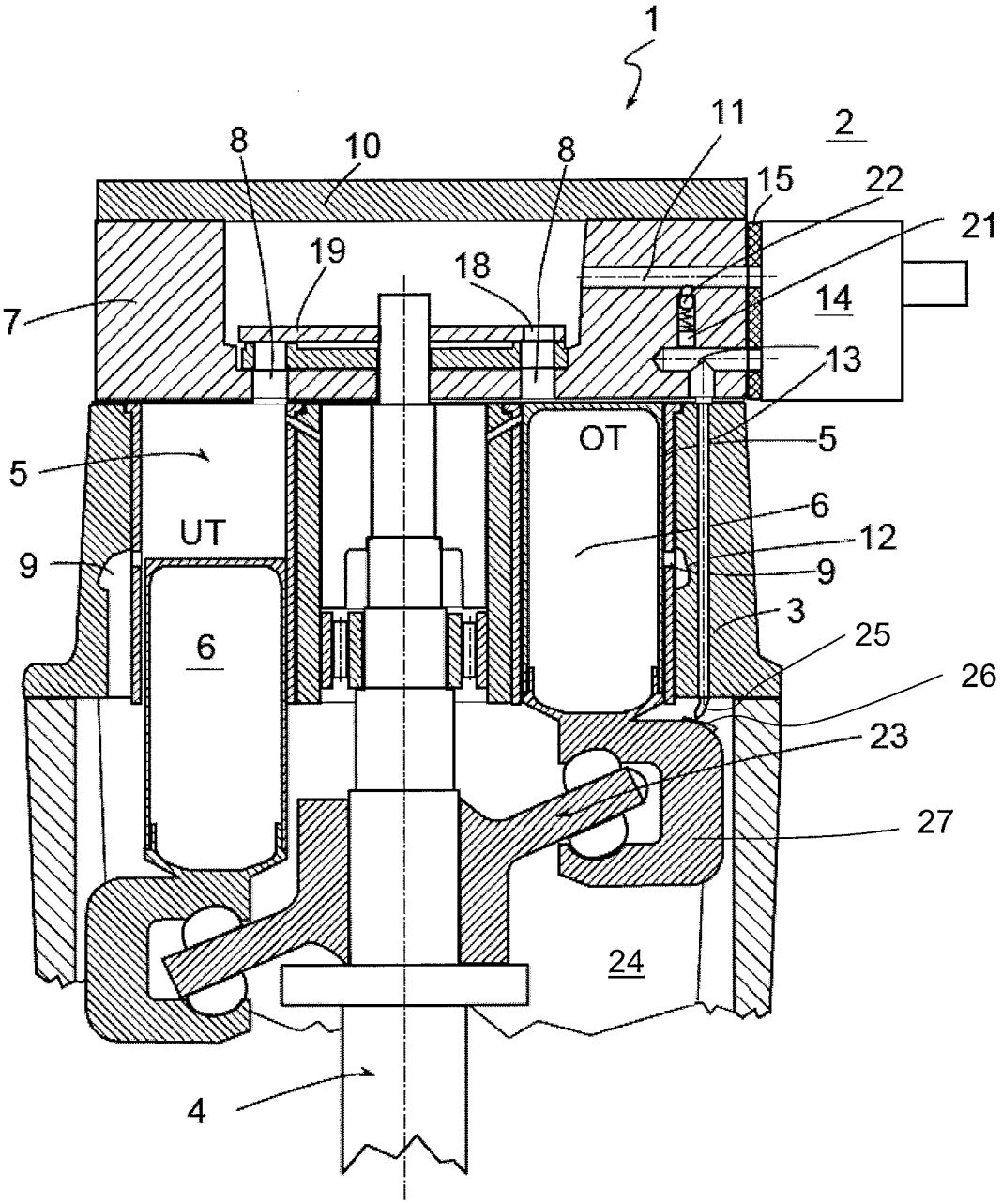
FIG. 4 shows a view according to the second alternative with a bypass channel opening into a swashplate space.

If FIGS. 1, 3 and 4 are considered, it can be seen that the bypass valve 14 is fastened to the outside of the cylinder head 7 via a decoupling element 15. The decoupling element 15 is used in particular for thermal decoupling of the bypass valve 14 from the cylinder head 7 and can for example be configured as an elastomer element and/or a thermal decoupling material.

If FIG. 2 is considered, a braking device 16 for braking the rotor 4 can be additionally seen which can be actuated by means of the working medium, i.e. via the bypass valve 14 or purely theoretically by means of compressed air. For this purpose a braking channel 17 is provided in the cylinder head 7 which is connected at one end to the bypass valve 14 and at the other end to the braking device 16 so that the braking device 16 can be actuated by means of the bypass valve 14. The braking device 16 is here configured in such a manner that it fixes the rotor 4 in a defined rotational position in which an opening 18 of a rotary valve disk 19 connected in a torque-proof manner to the rotor 4 is in alignment with an inlet opening 8 of a cylinder 5 wherein the piston 6 of this cylinder 5 is located in the area of an upper dead point. As a result, the rotor 4 can be stopped in a rotational angular position in which it can easily start running by application with vapour since the inlet aperture releases the working chamber and the piston 6 can be set in motion by gentle application of pressure. For this purpose the braking device 16 can comprise a pin 20 which in the defined rotational position engages in a recess arranged at the edge on the rotary valve disk 19 and thereby fixes the rotary valve disk 19 in the desired predefined rotational position. Naturally the braking device 16 can for example also comprise a brake shoe or a brake pad which acts on the rotary valve disk 19 or on another part rotating with the rotor 4. Purely theoretically a braking action can also be brought about without the braking device 16 if the bypass valve 14 specifically switches a counterpressure when the respective piston 6 in the outlet opening 9 of which air?? is blown in, rests at the lower dead point (cf. left piston in FIGS. 1 to 3). In this case, the rotary valve disk 19 would close the inlet opening 8 so that when working medium flows into the cylinder 5 via the outlet opening 9, an upward travel of the piston 6 and therefore a rotational movement of the rotor 4 would be braked.

In the axial piston machine according to FIGS. 3 and 4, a connecting channel 21 is provided between the inlet channel 11 and the bypass channel 13 in which an overpressure valve 22 is arranged. This overpressure valve 22 opens as soon as a predefined limiting pressure of the working medium is exceeded whereupon the working medium blows out into the bypass channel 13 via the connecting channel 21. As a result, the axial piston machine 1 can be shut down until a subcritical pressure at which the overpressure valve 22 does not respond is present without the bypass valve 14 itself needing to be switched for this purpose. This enables a particularly rapid switching which is particularly advantageous in the so-called failsafe case.

If the embodiment of the axial piston machine 1 according to FIG. 4 is observed, it can be seen that the bypass channel 13 opens into the swashplate space 24 and has a nozzle 25 at its end facing the swashplate space 24. This is directed towards an impact surface 26 of the sliding foot 27 connected to the piston 6 and thus serves as a starting aid whereby a vapour jet emerging therefrom presses the piston 6 downwards. When starting the axial piston machine 1, a translational starting impulse can be applied to the sliding foot 27 and a rotational starting impulse can be applied to the swashplate 23 via the nozzle 25.

Figure 5:
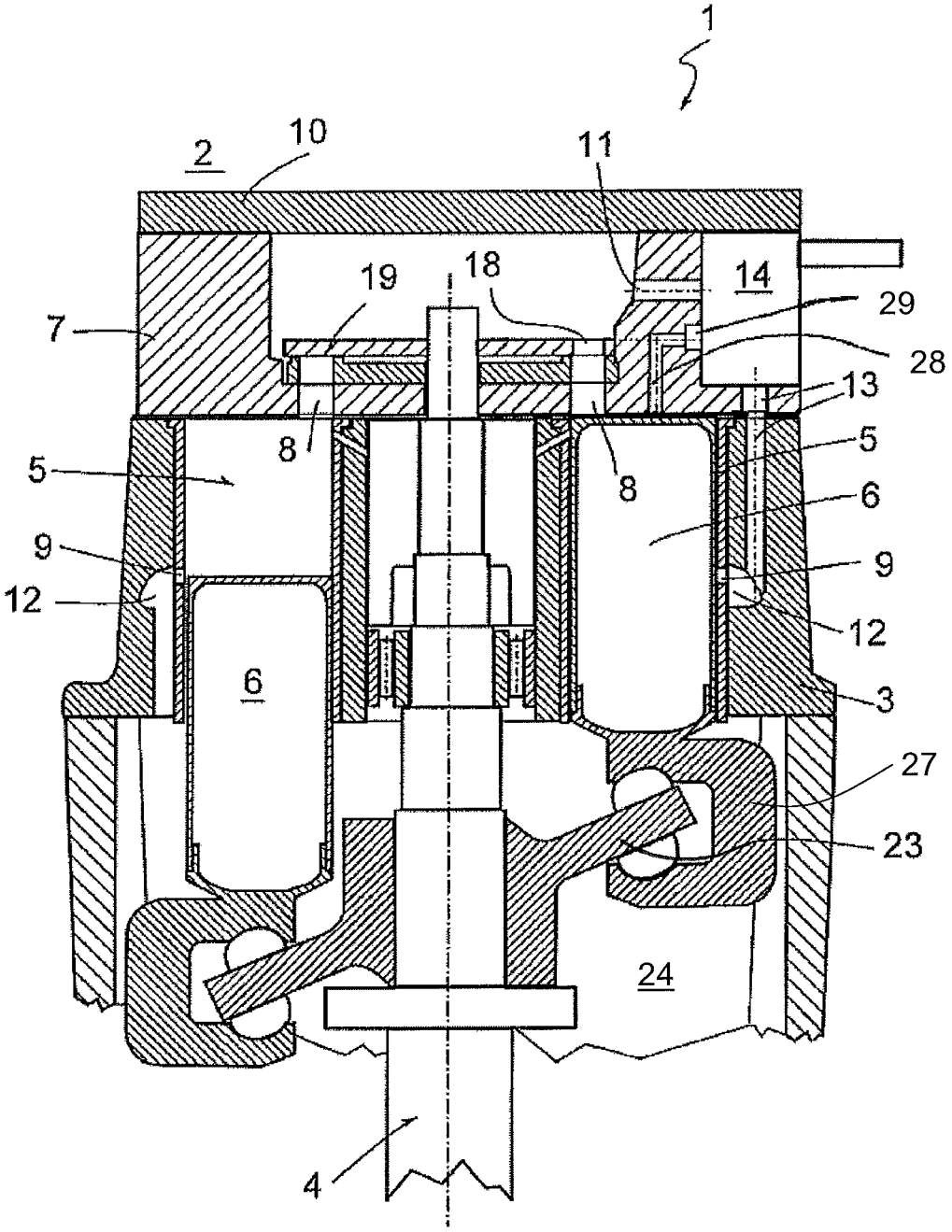
FIG. 5 shows a view similar to FIG. 2 but with a starter channel.

If the embodiment of the axial piston machine 1 according to FIG. 5 is considered, it can be seen that in this a starter channel 28 is provided in the cylinder head 7 which is connected to the cylinder 5 on the output side and has a valve 29 on the input side which can be configured separately from the bypass valve 14 or as part of the same. A translational starting impulse can be applied to the piston 6 via the starter channel 28. An overpressure valve 22 could be arranged in the bypass channel 13 in similar manner to FIGS. 3, 4.

With the axial piston machine 1 according to the invention, not only an arrangement of the bypass channel 13 in the cylinder head 7 or in the housing 3 which is optimized in terms of installation space is possible but the bypass channel 13 enables a media guidance comparatively close to real operation without the axial piston machine 1 being actuated.

Thus, for example, it is possible to separate lubricant contained in the working medium as is already provided in active operation. As a result, the axial piston machine 1 can be optimally lubricated when restarting, in particular lubrication of the swashplate 23 is possible. As a result of the bypass channel 13 being guided through the housing 3, a more rapid heating of the housing 3 can be achieved.

If the bypass valve 14 is attached to the outside of the cylinder head 7 as shown according to FIGS. 1, 3 and 4, a comparatively high modularity or flexibility can be achieved since the axial piston machine 1 can be used purely theoretically even without the bypass valve 14. By integrating the same in the cylinder head 7, however an extremely compact design can be achieved.

The invention claimed is:

1. An axial piston machine comprising:

a housing;

a cylinder head;

a rotor rotatably mounted in the housing;

a plurality of cylinders arranged in a ring around the rotor;

a plurality of pistons each arranged within a respective one of the plurality of cylinders and configured to selectively translate therein;

a plurality of inlet openings defined in the cylinder head, each of the plurality of inlet openings in operative communication with an associated one of the plurality of cylinders;

a plurality of outlet openings defined in the housing, each of the plurality of outlet openings in operative communication with an associated one of the plurality of cylinders;

an inlet channel defined in the cylinder head, the inlet channel selectively in fluid communication with the plurality of inlet openings;

an outlet channel defined in the housing in operative communication with the plurality of outlet openings;

a bypass channel defined at least partially within the housing extending from the cylinder head into the outlet channel;

a bypass valve connected to the cylinder head; and wherein the bypass valve is structured and arranged to selectively apportion a working medium to the inlet channel and the bypass channel based on a switching position of the bypass valve.

2. The axial piston machine according to claim 1, wherein the bypass valve is secured to an outside surface of the cylinder head via a thermal decoupling material.

3. The axial piston machine according to claim 2, wherein the thermal decoupling material is an elastomer body.

4. The axial piston machine according to claim 1, further comprising a braking device disposed within the cylinder head, wherein:

the braking device is structured and arranged to brake the rotor when actuated; and the braking device is actuatable via at least one of the working medium and a compressed air.

5. The axial piston machine according to claim 4, further comprising a braking channel defined in the cylinder head, wherein a first end of the braking channel is connected to the bypass valve and a second end of the braking channel is connected to the braking device such that the braking channel facilitates actuation of the braking device via the bypass valve.

6. The axial piston machine according to claim 4, further comprising a rotary valve disk connected in a torque-proof manner to the rotor, wherein:

the rotary valve disk includes an opening;

the braking device is structured and arranged to secure the rotor in a defined rotational position; and when the rotor is in the defined rotational position, the opening of the rotary valve disk is aligned with an inlet opening of the plurality of inlet openings that is in operative communication with a cylinder of the plurality of cylinders in which a piston of the plurality of pistons is disposed in an area of an upper dead point.

7. The axial piston machine according to claim 6, wherein:

the braking device includes a pin structured and arranged to engage a recess defined on the rotary valve disk; and the pin engages the recess when the rotor is in the defined rotational position securing the rotor in the defined rotational position.

8. The axial piston machine according to claim 1, further comprising:

a connecting channel extending between and connecting the inlet channel and the bypass channel; and an overpressure valve disposed within the connecting channel.

9. The axial piston machine according to claim 1, wherein the bypass channel is defined at right angles in relation to an external surface of at least one of the cylinder head and the housing.

10. A heat recovery system in a motor vehicle with the axial piston machine according to claim 1.

11. The axial piston machine according to claim 1, wherein the bypass valve is integrated within the cylinder head.

12. The axial piston machine according to claim 1, further comprising a starter channel defined in the cylinder head operatively connected to an output side of at least one of the plurality of cylinders, wherein the starter channel includes a valve disposed on an input side of at least one of the plurality of cylinders.

13. The axial piston machine according to claim 1, wherein:

the bypass channel further extends through the cylinder head to the bypass valve; and the inlet channel is connected to the bypass valve such that the bypass valve is selectively in fluid communication with the plurality of inlet openings via the inlet channel.

14. The axial piston machine according to claim 1, wherein:

the plurality of cylinders extend through a surface of the housing; and the cylinder head is arranged on and coupled to the surface of the housing.

15. The axial piston machine according to claim 14, wherein:

the bypass channel extends to the outlet channel;

a first portion of the bypass channel is disposed completely within and defined by the housing, the first portion of the bypass channel extending from the surface of the housing to the outlet channel; and a second portion of the bypass channel is disposed completely within and defined by the cylinder head, the second portion of the bypass channel connected to the first portion of the bypass channel in a region of the surface of the housing.

16. The axial piston machine according to claim 15, wherein the second portion of the bypass channel extends within the cylinder head from a surface of the cylinder head facing the housing to a side surface of the cylinder head on which the bypass valve is arranged.

17. The axial piston machine according to claim 15, wherein:

the first portion of the bypass channel is disposed radially outside of the plurality of cylinders relative to the rotor; and the first portion of the bypass channel, at least partially, extends within the housing in an axial direction of the plurality of cylinders.

18. An axial piston machine comprising:

a housing;

a cylinder head coupled to a surface of the housing;

a rotor rotatably mounted in the housing;

a plurality of cylinders arranged within the housing in a ring around the rotor and extending through the surface of the housing;

a plurality of pistons each arranged within a respective one of the plurality of cylinders and configured to selectively translate therein;

a plurality of inlet openings defined in the cylinder head, each of the plurality of inlet openings in operative communication with an associated one of the plurality of cylinders;

a plurality of outlet openings defined in the housing, each of the plurality of outlet openings in operative communication with an associated one of the plurality of cylinders;

an inlet channel defined in the cylinder head, the inlet channel selectively in fluid communication with the plurality of inlet openings;

an outlet channel defined in the housing in operative communication with the plurality of outlet openings;

a bypass valve connected to the cylinder head;

a bypass channel extending from the bypass valve to the outlet channel, the bypass channel disposed completely within the housing and the cylinder head; and wherein the bypass valve is structured and arranged to selectively apportion a working medium to the inlet channel and the bypass channel based on a switching position of the bypass valve.

* * * * *